US006558015B1

(12) United States Patent
Marmaropoulos et al.

(10) Patent No.: US 6,558,015 B1
(45) Date of Patent: May 6, 2003

(54) TRIPLE MODE LAMP

(75) Inventors: George Marmaropoulos, Yorktown Heights, NY (US); Stefano Marzano, Eindaoven (NL); Jack Mama, Brighton (GB); Giang Vu, Ossining, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/043,383

(22) Filed: Oct. 26, 2001

(51) Int. Cl.[7] ..... F21V 9/16

(52) U.S. Cl. ..... 362/84; 362/228; 362/234; 362/395; 362/236

(58) Field of Search ..... 362/84, 228, 234, 362/394, 395, 235, 236, 257

(56) References Cited

U.S. PATENT DOCUMENTS 1,889,567 A * 11/1932 Persons ..... 415/121.3
4,816,969 A * 3/1989 Miller ..... 362/130
5,654,552 A * 8/1997 Toombs ..... 250/462.1
5,833,349 A * 11/1998 Apple ..... 362/84
6,322,228 B1 * 11/2001 Feldman ..... 362/84

* cited by examiner

*Primary Examiner*—Sandra O'Shea
*Assistant Examiner*—Sharon Payne
(74) *Attorney, Agent, or Firm*—Aaron Waxler

(57) ABSTRACT

A lamp assembly for general illumination and/or ornamentation has a base with a support member bearing both a lamp-bulb receiving socket and a lamp shade. The lamp shade, or other ornamental element of the lamp assembly is formed at least in part of an electroluminescent material and, in the disclosed form, the inner surface of the shade is reflective. The lamp assembly, accordingly, includes two sources of illumination, namely the electroluminescent material and a lamp-bulb received in the bulb-receiving socket. A conventional line cord is provided to connect the lamp to any ordinary source of electrical power, and a four-position electrical switch coupled to the line cord permits a user to direct power selectively to the lamp socket, or to the electroluminescent shade, or to both simultaneously. In its fourth position, all electrical power is cut-off so that the lamp is not illuminated.

9 Claims, 1 Drawing Sheet

TRIPLE MODE LAMP

BACKGROUND OF THE INVENTION

1. Field of the Invention

This invention relates generally to decorative and ornamental lamps of the type widely used in homes and offices, and more specifically relates to a combination lamp of this type incorporating two different forms of illumination.

2. Description of the Related Art

Lamps that provide plural forms of illumination, as for example, by providing for variations in lighting intensity, or by providing multiple incandescent lamp bulbs of different sizes or in spaced-apart locations, are well known In the art. Some such lamps have been known to incorporate different materials that respond in various ways to different types of lamp bulbs to achieve decorative effects. However, such lamps have not previously incorporated combinations of entirely different kinds of electrically powered illuminating materials in which one material provides useful illumination for tasks such as reading or supervising the activities of children, while another material provides structural form in combination with ornamental illumination.

SUMMARY OF THE INVENTION

Accordingly, the present invention relates to a combination lamp assembly in which two different kinds of illuminating material are incorporated to provide a combination of ornamental and functional illumination, or a choice of either one individually.

One aspect of the present invention is to provide a combination lamp assembly in which at least one kind of illuminating material serves both as a functional member of the lamp and as a source of illumination.

Another aspect of the present invention relates to a combination lamp assembly in which one of the kinds of illuminating materials is incorporated into the lamp assembly as a shade element for another kind of illuminating material in the lamp assembly.

These and other and further objects, features and advantages of this invention will be made apparent to those having skill in this art by reference to the following specification, considered in conjunction with the accompanying drawings, in which:

DETAILED DESCRIPTION OF THE INVENTION

Figure 1:
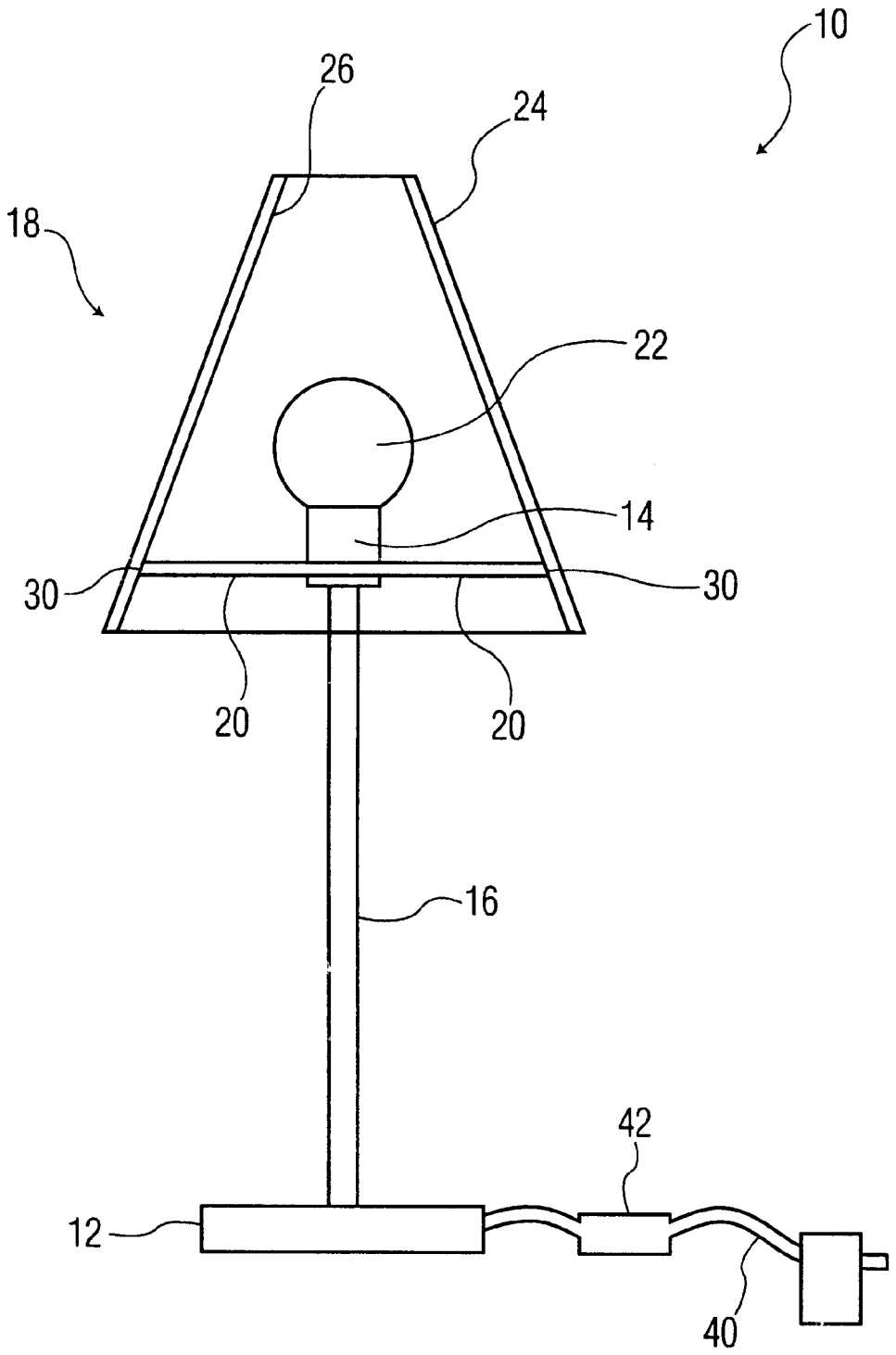
FIG. 1 is a diagrammatic front elevation view, in partial section, showing a preferred embodiment of a combination lamp assembly in accordance with this invention.

In the following description, for purposes of explanation rather than limitation, specific details are set forth such as the particular architecture, interfaces, techniques, etc., in order to provide a thorough understanding of the present invention. Moreover, for purposes of simplicity and clarity, detailed descriptions of well-known devices, circuits, and methods are omitted so as not to obscure the description of the present invention with unnecessary detail.

Referring now to FIG. 1 of the drawings, a combination lamp assembly 10 in accordance with this invention may be seen to comprise a base 12, a conventional lamp bulb socket 14 mounted to the base 12, and a lamp shade 18 also mounted to the base 12. As shown, the lamp shade 18 and the bulb socket 14 are mounted to the base 12 by a support member 16 extending from the base 12. A lamp shade support bracket 20 coupled to support member 16 proximate the free end thereof supports the lamp shade 18 in a desired position relative to base 12.

Any suitable form of electrical lamp bulb 22 may be received and engaged in lamp bulb socket 14, while lamp shade 18 is formed at least in part of an electroluminescent sheet material 24 of the type that emits light when subjected to an electrical potential difference. It is noted that the color of the electroluminescent sheet material 24 is different when the material is powered and when it is not powered. For example, a pink color electroluminescent sheet emits white color light when it is powered. In the illustrated embodiment of the invention, the electroluminescent material 24 forms the outermost surface of shade 18, while the inner surface of the shade 18 is preferably formed of a reflective material 26. Although this is a preferred embodiment of the invention, other elements of assembly 10 may be formed of or covered in electroluminescent material if desired.

In accordance with this invention, a line cord 40 is provided to connect the lamp assembly to any ordinary source of electrical power, while a four-position electrical switch 42 is coupled to the line cord associated with said lamp assembly to apply electrical power selectively to any one of said bulb-receiving socket 14, said electroluminescent shade 18, and the combination of both said socket 14 and said shade 18. Accordingly, the four positions of the switch 42 correspond to: [1] off; [2] electrical power supplied to bulb 22 only; [3] electrical power supplied to electroluminescent material 24, only; [4] electrical power supplied to both bulb 22 and electroluminescent material 24.

To electrically energize lamp bulb socket 14, electrical conductors, not shown, extend from switch 42 through upright support member 16 to couple line cord 40 to lamp bulb socket 14, while separate conductors, also not shown, may pass through upright 16 and further through lamp shade support bracket 20 so as to couple line cord 40 electrically, to electroluminescent material 24 of lamp shade 18 using separable electrical connector elements 30 at the ends, for example, of support bracket 20.

Although a preferred embodiment of the invention has been illustrated and described, it will be obvious to those having skill in this art that various other forms and embodiments of the invention now may be visualized, readily, by those having skill in this art, without departing substantially from the spirit and scope of the invention set forth in the accompanying claims.

What is claimed is:

1. A combination lamp assembly comprising:

a base;

a lamp-bulb receiving socket supported on said base;

a lamp shade coupled to said base in co-operative shading relationship with said bulb-receiving socket;

said lamp shade being formed at least in part of electroluminescent material;

an operable four-position electrical switch associated with said lamp assembly for connection to a source of electrical power and electrically coupled to apply electrical power selectively to any one of said bulb-receiving socket, said electroluminescent shade, and the combination of both said socket and said shade.

2. A lamp assembly in accordance with claim 1, further comprising:

an electrical line cord coupled to said operable four-position switch, for supplying electrical power to said four-position electrical switch.

3. A lamp assembly in accordance with claim 1, wherein said lamp shade is formed with said electroluminescent material on the exterior thereof and with a reflective inner surface.

4. A lamp assembly in accordance with claim 1, further comprising:

an upright support member extending from said base to a free end remote from said base, said bulb-receiving socket and said lamp shade being coupled to said base proximate said free end of said upright support member.

5. A lamp assembly in accordance with claim 4, further comprising:

a lamp shade bracket coupled to said free end of said upright support bracket for supporting said lamp shade.

6. A lamp assembly in accordance with claim 5, further comprising:

electrical connector elements positioned to connect said electroluminescent material of said lamp shade to said four-position electrical switch.

7. A lamp assembly in accordance with claim 5, wherein the color of said electroluminescent material changes when connected to the source of said electrical power.

8. A combination lamp assembly comprising:

a base member;

a lamp-bulb receiving socket coupled to said base member;

a shaped, ornamental element formed at least in part of electroluminescent material mounted to said base member;

an operable four-position electrical switch associated with said lamp assembly for connection to a source of electrical power;

said electrical switch being electrically coupled to apply electrical power selectively to any one of said bulb-receiving socket, said electroluminescent material, and the combination of both said socket and said luminescent material.

9. A combination lamp assembly in accordance with claim 8, wherein the color of said electroluminescent material changes when connected to the source of said electrical power.

* * * * *